US008596007B2

(12) United States Patent
Hibbs

(10) Patent No.: US 8,596,007 B2
(45) Date of Patent: Dec. 3, 2013

(54) PANEL MOUNTING SYSTEM

(75) Inventor: Colin Hibbs, Buckinghamshire (GB)

(73) Assignee: Protean Design Limited (GB)

( * ) Notice: Subject to any disclaimer, the term of this patent is extended or adjusted under 35 U.S.C. 154(b) by 353 days.

(21) Appl. No.: 12/741,633

(22) PCT Filed: Oct. 2, 2008

(86) PCT No.: PCT/GB2008/003322

§ 371 (c)(1),
(2), (4) Date: Aug. 16, 2010

(87) PCT Pub. No.: WO2009/063157

PCT Pub. Date: May 22, 2009

(65) Prior Publication Data

US 2010/0307086 A1 Dec. 9, 2010

(30) Foreign Application Priority Data

Nov. 13, 2007 (GB) ..... 0722231.8

(51) Int. Cl.
*E04C 2/34* (2006.01)

(52) U.S. Cl.
USPC ..... 52/481.2; 52/204.62; 52/506.03; 52/506.06; 52/506.08; 52/489.2; 52/489.1; D25/61; 248/317; 403/204

(58) Field of Classification Search
USPC ..... 52/506.03, 506.06, 512, 461, 464, 509, 52/745.1, 222, 273, 235, 506.08, 506.09, 52/510, 511, 489.1, 316, 771, 772, 774, 52/766, 770, 468, 483.1, 460, 762, 582.1; D25/61, 119, 120, 127, 133, 138; 248/317, 342, 343; 403/204
See application file for complete search history.

(56) References Cited

U.S. PATENT DOCUMENTS

| | | | | |
|---|---|---|---|---|
| 3,553,915 | A * | 1/1971 | Passovoy | 52/241 |
| 4,356,672 | A * | 11/1982 | Beckman et al. | 52/36.6 |
| 4,520,607 | A | 6/1985 | Suckow | |
| 5,644,878 | A * | 7/1997 | Wehrmann | 52/287.1 |
| 5,806,257 | A * | 9/1998 | Cornils et al. | 52/208 |
| 6,101,777 | A * | 8/2000 | Bodine et al. | 52/506.06 |
| 6,164,364 | A * | 12/2000 | Morris | 160/327 |
| 6,226,947 | B1 * | 5/2001 | Bado et al. | 52/483.1 |
| 6,431,251 | B1 * | 8/2002 | Yerusalim et al. | 160/327 |
| 6,574,936 | B1 * | 6/2003 | Anderson, Sr. | 52/506.06 |
| 7,562,504 | B2 * | 7/2009 | Herbst et al. | 52/461 |
| 8,074,411 | B1 * | 12/2011 | Anderson et al. | 52/222 |
| 2002/0124514 | A1 * | 9/2002 | Higgins | 52/506.06 |
| 2002/0152704 | A1 * | 10/2002 | Thompson et al. | 52/506.06 |

FOREIGN PATENT DOCUMENTS

| | | | |
|---|---|---|---|
| GB | 2322646 | A | 9/1998 |
| WO | WO2005049939 | | 6/2005 |

OTHER PUBLICATIONS

European Search Report, Feb. 19, 2010.

* cited by examiner

*Primary Examiner* — Chi Q Nguyen
(74) *Attorney, Agent, or Firm* — Clark Hill PLC

(57) ABSTRACT

A panel mounting system includes a support frame having at least one longitudinal frame member with a recess and a catch. A panel has a gripping member extending along a substantial length of the panel, the gripping member having a resiliently deflectable cross-section for engaging the longitudinal frame member. In a first position the gripping member engages the recess so as to hold the panel to the frame. In a second position the gripping member engages the catch, the catch holding the gripping member in the second position, so as to free the panel from the frame.

22 Claims, 5 Drawing Sheets

PANEL MOUNTING SYSTEM

This application is a National Phase filing of PCT/GB2008/003322, having an International tiling date of Oct. 2, 2008, and which was published in English on May 22, 2009 under WO 2009/063157 and which claims priority from British application number 0722231.8, filed on Nov. 13, 2007. The disclosure of each of these applications is herein incorporated by reference.

FIELD OF THE INVENTION

The present invention relates to a panel mounting system. In particular, the invention relates to a system for erecting and disassembling temporary or semi-permanent panel systems.

BACKGROUND OF THE INVENTION

Temporary and semi-permanent panel systems are commonly employed in a variety of situations. For example, a panel system may be used for display purposes at an exhibition or it may be used as a partition wall in order to divide up a room, in which case the panels usually extend from the floor to the ceiling. The panel system should be readily erected with accurate alignment of the component parts and once assembled, it should be able to withstand minor impacts. When the panel system is no longer required, it should be readily disassembled without damage to the component parts so that they may be re-used.

In known panel systems, panels are supported on a frame by means of suitable fasteners. In many cases there are unattractive gaps between the panels, through which the frame may be seen. These gaps provide a passage through the panel system such that the system is a poor barrier for noise, heat and even the spread of fire. In known panel systems, disassembly is often an awkward process and sometimes results in damage to the panels so that they cannot be re-used.

SUMMARY OF THE INVENTION

It is an object of the present system to provide a panel mounting system in which panels can be mounted to a frame and disassembled for subsequent re-use. It is a further objective to provide a panel mounting system in which the aforementioned problems are alleviated.

According to a first aspect of the present invention, there is provided a panel mounting system comprising: a support frame having at least one longitudinal frame member comprising a recess and a catch; and a panel having a gripping member extending along a substantial length of the panel, the gripping member having a resiliently deflectable cross-section for engaging the longitudinal frame member; wherein the gripping member in a first position engages the recess so as to hold the panel to the frame, and in a second position engages the catch, the catch holding the gripping member in the second position, so as to free the panel from the frame.

It is an advantage that the resiliently deflectable cross-section of the gripping member allows the panels to be mounted to the support frame and subsequently, allows the panel system to be disassembled. The panel system is re-usable and therefore suitable for temporary and semi-permanent installations.

Preferably, the gripping member and support frame cross-sections are such that when the gripping member is in the first position it is squeezed into the frame in a compressed condition. It is an advantage that the panel is firmly attached to the support frame when the gripping member is engaged within the recess (the first position).

In order to disassemble the panel system it is necessary to disengage the gripping member from the recess in the longitudinal frame member. Without the catch, this could prove difficult since the gripping member must be disengaged along its full length, but the resilience of the cross-section means that it is being urged back towards engagement with the recess. Thus a portion of the length of the gripping member would tend to return to the locked position before the remainder is disengaged.

It is an advantage of the present invention that the panel is released from the longitudinal frame member when the full length of the gripping member is engaged with the catch (the second position) rather than the recess (the first position). The panel is released by shifting the gripping member from the first position to the second position by means of a release tool. The release tool is inserted near one end of the panel edge, and moved toward the other end of the panel edge. As it is moved along the panel edge the gripping member is shifted from the first position to the second position.

The frame may comprise lateral frame members that extend between the longitudinal frame members and are engageable therewith to stiffen the frame.

In a preferred embodiment the longitudinal frame members are formed of an extruded section. Preferably, the extruded section is formed of a fire resistant material, for example a metal such as aluminum. The lateral frame members may be of a similar construction.

The panel may be made from any type of sheet or board material, including metal, a plastics material, glass, cardboard or a composite material. The panel may be flexible, semi-rigid or rigid. In a preferred embodiment, the panel is made from an aluminum composite material such as DiBond®, The gripping member is preferably attached to a back face of the panel. The gripping member is preferably attached adjacent to the edge of the panel. The gripping member is conveniently attached to the panel by bonding means, for example an adhesive, or an adhesive tape.

According to a second aspect of the present invention there is provided a gripping member attachable to a panel for holding the panel to a longitudinal frame member in a panel mounting system, wherein the gripping member has a resiliently deflectable cross-section for engaging the longitudinal frame member in a first position, so as to hold the panel to the frame member, and in a second position, for releasing the panel from the frame member.

In preferred embodiments, the gripping member is formed by extrusion. The gripping member may be made from a plastics material, preferably polypropylene (PP) or polyvinyl chloride (PVC). Alternatively, the gripping member may comprise a plurality of materials formed by co-extrusion. Preferably, the materials comprise PVC and a thermoplastic polyester elastomer such as Hytrel®.

In preferred embodiments, the cross-section of the gripping member comprises a first part for attaching to the panel and a second part for engaging the longitudinal frame member. Preferably, the first and second parts each comprises an arm, the arms being connected such that said cross section has a V shape. The second part may comprise a hook for engaging the longitudinal frame member in the first position and a lip for engaging the longitudinal frame member in the second position. Preferably, the first part is more rigid than the second part.

Conveniently, the cross-section further comprises a ridge against which a tool can be pushed to deflect the gripping member from the first position to the second position.

Preferably, the longitudinal frame members have a cross-section that facilitates mounting of a pair of neighbouring panels such that a gap between the panels does not exceed 5 mm. In this way both the gripping members and the frame are almost completely hidden from view behind the panels, thereby providing a panel system with an attractive appearance. Preferably, the cross section of the longitudinal frame members is such that, once the panels have been affixed to the frame by engagement of the gripping members, the panels and longitudinal frame members together provide a continuous barrier. It is an advantage, particularly when the panel system is to be used for a partition wall, that a continuous barrier provides improved noise reduction and fire safety by preventing passage of air from one side of the partition to the other.

Embodiments may include longitudinal frame members that facilitate mounting of parallel panels with a space between to provide a double-panel partition. This arrangement provides for both sides of the partition wall to have outward facing panels mounted to the frame. It is an advantage that the frame, rails and any other components used in assembly of the panel system can be concealed in the space between the panels. It is a further advantage that a double-panel partition provides a double barrier for enhanced fire safety.

The panel system may be employed in a wide variety of situations. The panel system may be employed for display purposes, for example in an exhibition hall or it may be employed as a partition wall in a room in a building. The panel system may be used to form a temporary enclosure, for example for toilet cubicles or to enclose lighting or audiovisual equipment.

The panel system will commonly be employed to provide a vertical barrier but in some circumstances the frame may be tilted at an angle from the vertical or it may even be held in a horizontal position. For example, the panel system may be used to hold ceiling panels in place, or may be used to provide a floor or raised platform. Depending on the choice of materials, the panel system may be used indoors or outside.

For the avoidance of doubt, it should be made clear that the invention resides also in the longitudinal frame members per se and the gripping member per se.

According to a third aspect of the present invention there is provided a panel mounting system comprising: a support frame; a plurality of panels mountable to the support frame off rear faces of the panels; at least one blocking strip; and an adhesive-backed tape. At least two of the panels, when mounted to the support frame, have a gap between adjacent panel edges, the adjacent panel edges having a form that includes a recess for receiving the blocking strip so as to obscure the gap. Each adjacent panel edge also has a rebate that extends to a distance beyond the blocking strip and to a depth from a front face of the panel that is greater than the thickness of the adhesive-backed tape by an amount that facilitates application of a plaster skim over the adhesive backed tape.

Preferably, the adhesive-backed tape is secured over the blocking strip and to the rebates in the adjacent panels on each side of the blocking strip, facilitating application of the plaster skim over the adhesive-backed tape and onto the front faces of the adjacent panels on each side.

The adhesive backed tape is preferably of a type that has a degree of resilience that enables it to take up the small movements between the blocking strip and the panels.

It is an advantage that the plaster skim is therefore not subjected to differential movements that would cause cracking to occur at the interface between the panels and the blocking strip. It is a further advantage that after construction and use of the panel system as a temporary construction, the panels can be readily dismantled and removed for re-use

BRIEF DESCRIPTION OF THE DRAWINGS

Embodiments of the invention are described below with reference to the following accompanying drawings, in which.

DETAILED DESCRIPTION OF THE ILLUSTRATED EMBODIMENTS

Figure 1A:
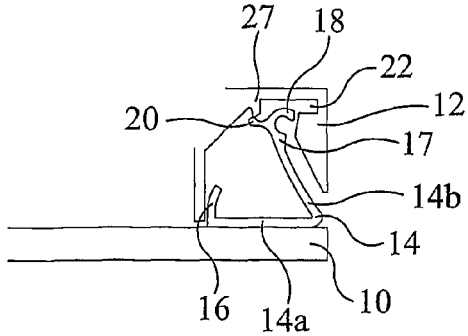
FIGS. 1*a*, 1*b* and 1*c* are partial sectional views showing the stages in mounting of a panel by means of a mounting system in accordance with one embodiment of the invention.
Figure 1B:
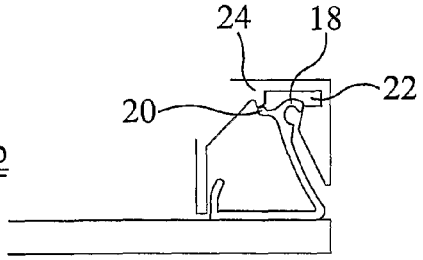
Figure 1C:
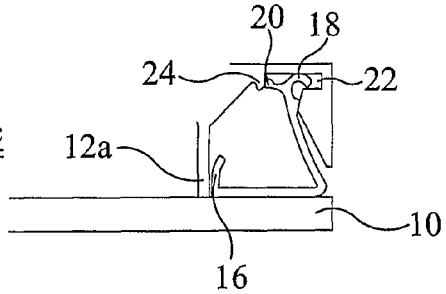

FIGS. 1*a*, 1*b* and 1*c* show plan views of the steps required to mount a panel 10 onto a section 12 of a longitudinal frame member (shown in full in FIGS. 2*a*-*c*) by means of a gripping member 14.

The gripping member 14 is a longitudinal element having a substantially uniform resiliently deflectable cross-section that extends the length of the edge of the panel 10. The cross-section of gripping member 14 is essentially 'V' shaped, having two arms 14*a* and 14*b*. The gripping member 14 is formed by extrusion from PVC such that the arm 14*a* is relatively rigid and the arm 14*b* is flexible. The arms 14*a* and 14*b* meet at the edge of the panel 14 so that the opening of the 'V' shape points toward the frame section 12. The arm 14*a* is affixed to the panel 10 and the end distant from the arm 14*b* bends inward, away from the panel 10, thereby forming a flange 16. Toward the end of the arm 14*b* that is distant from the arm 14*a*, there is a ridge 17 that assists in disassembly (discussed later). Beyond the ridge 17 the arm 14*b* splits into two parts; one part curves to the right (in this view) in the shape of a hook 18 and one part curves to the left (in this view) to form a lip 20.

The frame section 12 is formed by extrusion preferably of a fire resistant material such as aluminum. The extruded cross-section of the frame section 12 is essentially 'C' shaped with the opening of the 'C' pointing toward the panel 10 and being of a similar size to the gripping member 14. The interior of the frame section 12 is shaped to engage with the gripping member 14. It comprises a recess 22 and adjacent to the recess 22, a protrusion that acts as a catch 24.

Referring to FIG. 1*a*, the flange 16 of the gripping member 14 is used as a guide in order to direct the gripping member 14 into the interior of the frame section 12. In FIG. 1*b*, the gripping member 14 has been moved further toward the frame section 12 such that the lip 20 is in contact with the catch 24 and the hook 18 is next to the recess 22. In FIG. 1*c* the hook 18 and the lip 20 have been clipped into place within the recess 22 with the lip 20 abutting the catch 24 (the first position). The resiliently deflectable nature of the gripping member 14 means that that the hook 18 and the lip 20 are compressed within the recess 22 thereby holding the panel 10 firmly in place. The peripheral edge 12*a* of frame section 12 is in contact with the panel 10.

Figure 2C:
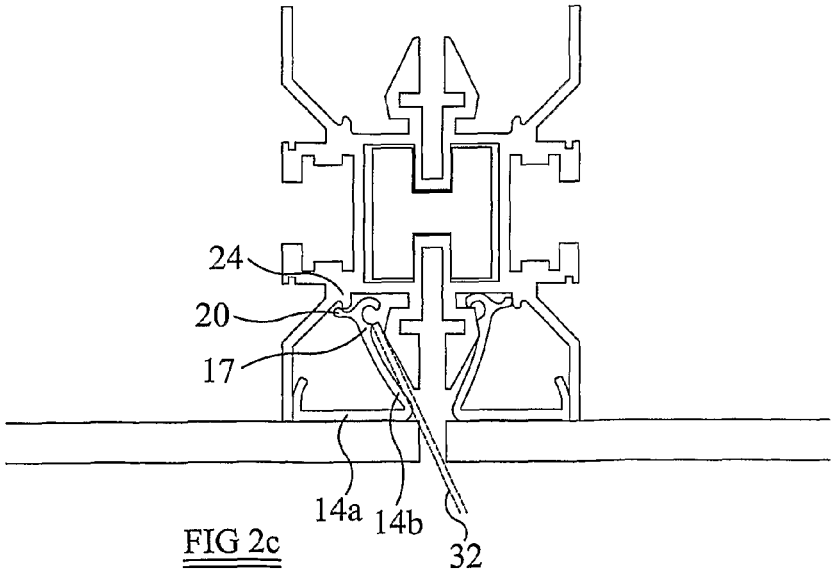
FIGS. 2*a*, 2*b* and 2*c* are partial section views of a panel mounting system and release tool in accordance with one embodiment of the invention.
Figure 2A:
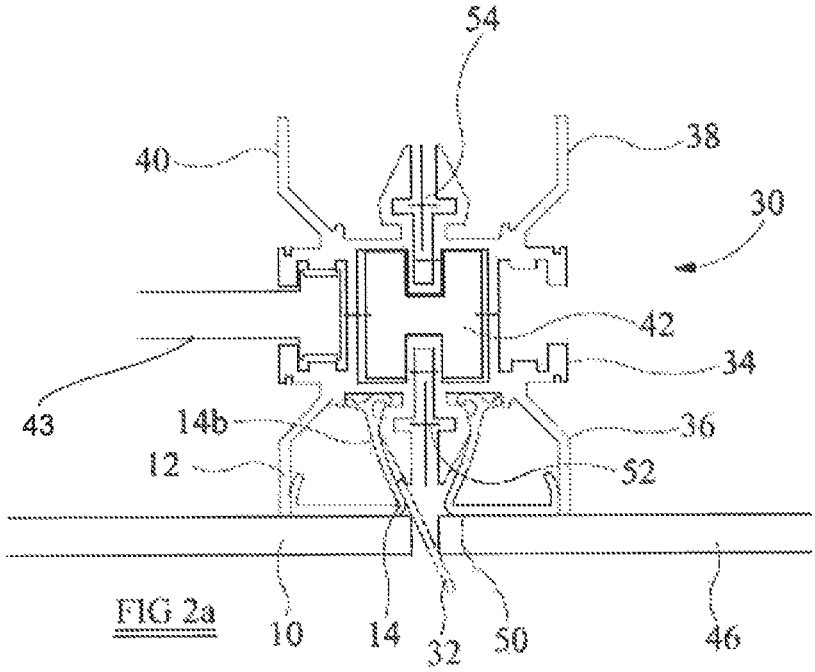
Figure 2B:
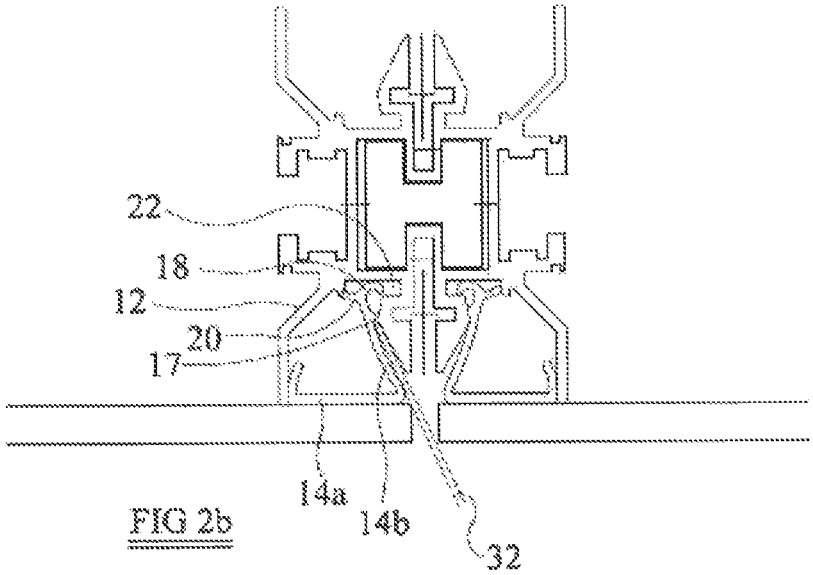

FIGS. 2*a*, 2*b* and 2*c* show plan views of the disassembly of a panel system 30 using a release tool 32. Panel system 30 has a longitudinal frame member 34 that includes four frame sections 12 (discussed above), 36, 38 and 40 that are located around a central bore 42. The longitudinal frame member is formed from extruded metal, preferably aluminum and each of the four frame sections 12, 36, 38, 40 has a 'C' shaped cross-section as discussed above. Lateral frame members 43 can extend between longitudinal frame members 34 and are engagable therewith to stiffen the frame. Two panels 10 (discussed above) and 46 are attached to the frame sections 12, 36 on the front side of the longitudinal frame member 34 by means of gripping members 14 (discussed above) and 50.

Referring to FIG. 2*a* both gripping members 14, 50 are in the first position as described above. The panels 10, 46 are in contact with the frame members 12, 36 such that there is no passage between from the front to the rear side of the panel system 30 thereby minimizing unsightly gaps between adjacent panels, reducing noise, eliminating draughts and providing some protection against the spread of fire. There is a small gap between panels 10 and 46, which leads to the interior of the frame members 12 and 36. A release tool 32 is inserted into the gap between the panels 10, 46 and then pressed against the arm 14*b* of gripping member 14.

Referring to FIG. 2*b* the release tool 32 has been pushed further along the arm 14*b* of gripping member 14 to the ridge 17. Pressing the release tool 32 against the ridge 17 prises the arm 14*b* from the frame section 12. This squeezes the arm 14*b* toward the arm 14*a* so as to dislodge the hook 18 and the lip 20 from the recess 22. In FIG. 2*b*, the lip 20 and the catch 24 are shown overlapping one another. It will be appreciated that, in reality, the lip 20 will deform from the position shown so that it rides over the catch 24.

Referring to FIG. 2*c* the release tool 32 has been pushed further along the arm 14*b* to the middle of the ridge 17, further squeezing the arm 14*b* toward the arm 14*a*. The lip 20 has been pushed past the catch 24 and is held in place (in the second position) due to the resiliently deflectable nature of the gripping member 14. The release tool 32 will then slide along the length of the gripping member 14 shifting it from the first position to the second position and thereby releasing the panel 10 from the from the frame section 12.

In this example panels 10, 46 are attached to the longitudinal frame member 34 on the front side only but the longitudinal frame member 34 is designed such that panels could also be attached to frame sections 38, 40 on the rear side, thereby providing a double panel partition.

Figure 3:
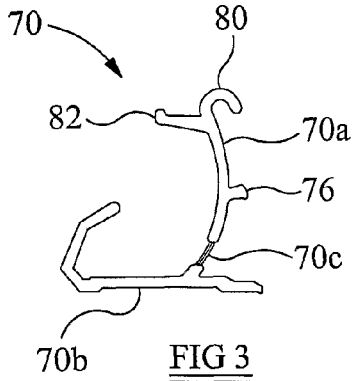
FIG. 3 is a sectional view of an embodiment of a gripping member for a panel mounting system.

Referring to FIG. 3, in another embodiment, a gripping member 70 is shown in cross-section. The gripping member 70 is a longitudinal element having a substantially uniform cross-section that is approximately 'V' shaped having two arms 70*a*, 70*b* made from a plastics material such as PVC linked by a small connecting piece 70*c* made from a thermoplastic polyester elastomer such as Hytrel®. The gripping member is made in one piece by co-extruding the two materials (e.g PVC and Hytrel®). The plastics (e.g. PVC) arms 70*a*, 70*b* are relatively stiff compared with the elastomer (e.g. Hytrel®) piece 70*c*, which is more flexible.

Part of the way along arm 70*a* there is a ridge the purpose of which will be discussed later. Toward the end of the arm 70*a* it splits into two parts; one part curves to the right (in this view) to form a hook 80 and the other part projects to the left (in this view) to form a lip 82. The arm 70*b*, which will be affixed to a panel, has an end distant from the connecting piece 70*c* that curls inwards to form a flange 84.

Figure 4A:
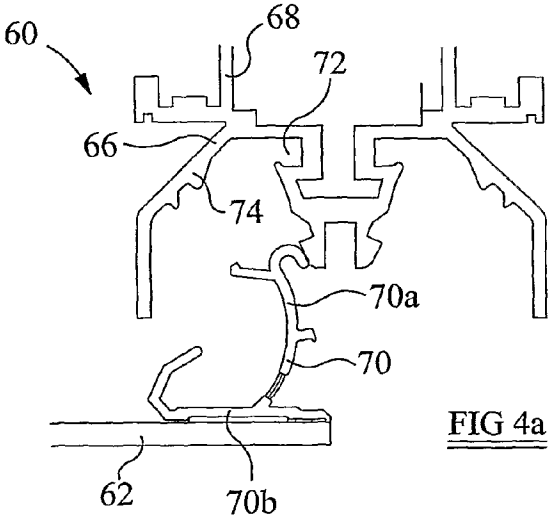
FIGS. 4*a*, 4*b*, 4*c* and 4*d* are partial section views showing the stages in mounting of a panel by means of a mounting system incorporating the gripping member of FIG. 3.
Figure 4B:
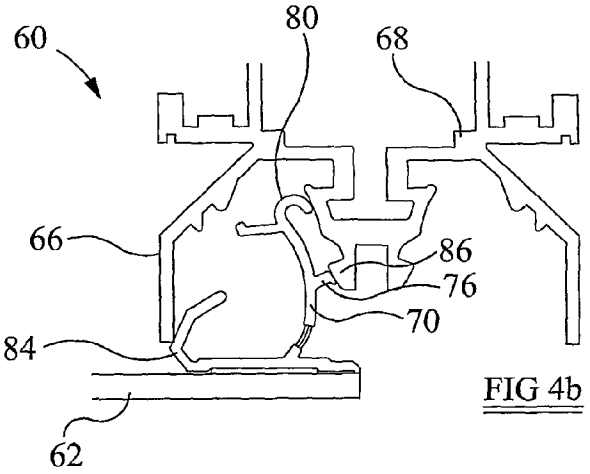
Figure 4C:
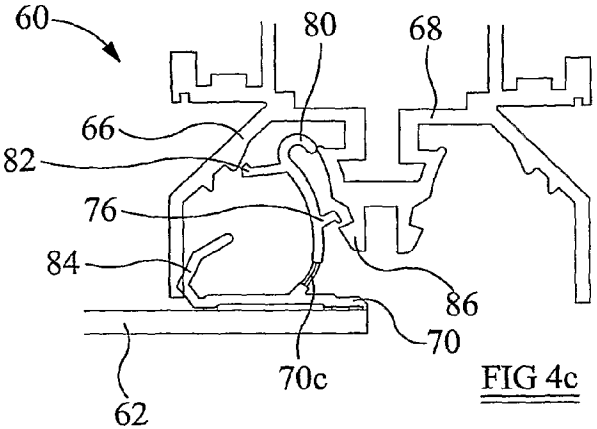
Figure 4D:
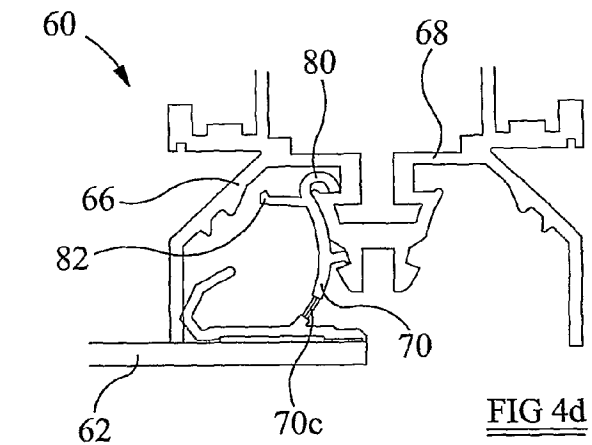

FIGS. 4*a*, 4*b*, 4*c* and 4*d* show the stages of assembly of a panel system 60, that includes a panel 62 with a gripping member 70 attached on the back of the panel. In FIG. 4*a* the panel 62 is offered up to a longitudinal frame member 68 such that the gripping member 70 is aligned with a C-shaped frame section 66 of a longitudinal frame member 68, which is formed from extruded metal, preferably aluminum. The interior of the frame section 66 is shaped to engage with the gripping member 70, having a recess 72 for holding the gripping member 70 in a first position and a protrusion 74 (a catch) for holding the gripping member 70 in a second position. The shape of the gripping member 70 and the frame section 66 are such that as the panel 62 is pushed towards the frame member 68, abutment of the surfaces leads the panel 62 into alignment with the frame. In FIG. 4*b*, the panel 62 is fully aligned, with the gripping member 70 contacting the frame section 66 in three places—at the hook 80, the flange 84 and the ridge 76, which is touching an abutment 86 on the frame 68. In FIG. 4*c* the panel has been pushed further into the frame such that the ridge 76 has moved past the abutment 86, while the lip 82 has come into contact with a surface inside the C-shaped section 66. In moving to this position the gripping member 70 has been squeezed such that the resiliently flexible piece 70*c* has become bent. Finally, in FIG. 4*d*, the gripping member 70 has been pushed such that the lip 82 and hook 80 have been squeezed into the innermost part of the frame section 66. In this position (the first position), the resilience of the flexible piece 70*c* urges the hook 80 to engage in a recess 72 in the frame section 66.

Figure 5B:
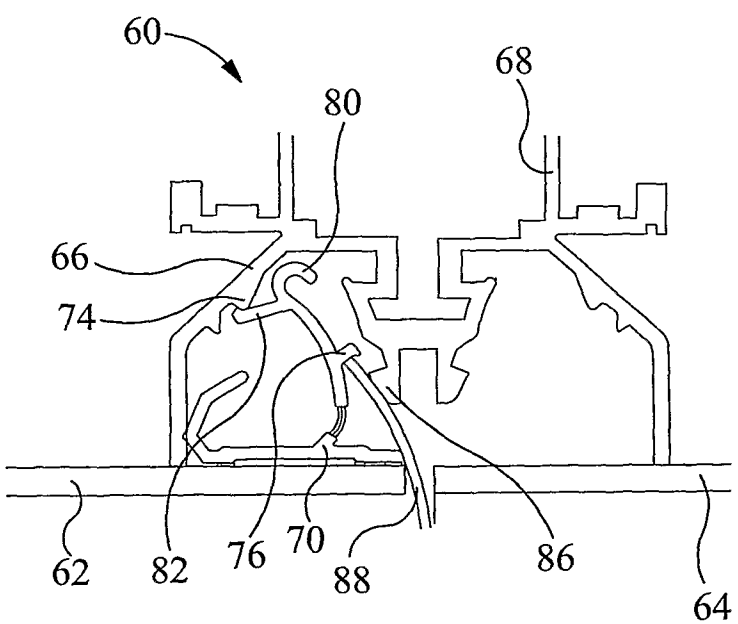
FIGS. 5*a* and 5*b* are partial section views showing the stages in releasing of a panel from a mounting system incorporating the gripping member of FIG. 3.
Figure 5A:
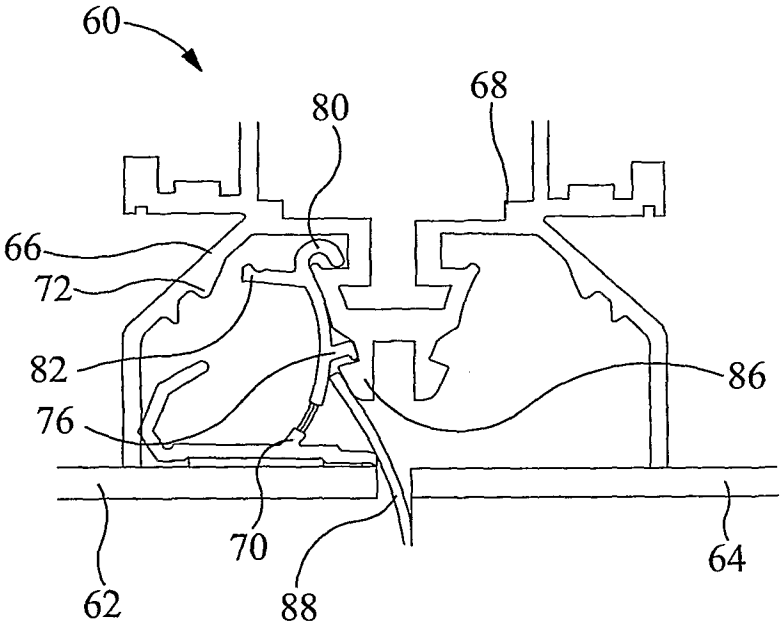

Referring to FIGS. 5*a* and 5*b*, a panel, mounted as described above with reference to FIGS. 4*a* to 4*d*, is released using a flexible release tool 88. In these illustrations, the panel system 60 includes a second panel 64 that is attached to an adjacent C-shaped frame section of the longitudinal frame member 68, such that there is a narrow gap 90 between the adjacent panel edges. The release tool 88 is first placed at one end of the edge of the panel 62 that is to be released. As shown in FIG. 5*a*, the release tool 88 has a curved blade, which is pushed through the narrow gap 90 and between the abutment 86 on the frame member and the gripping member 70.

Referring to FIG. 5*b*, the release tool 88 has been pushed firmly against the ridge 76 of the gripping member 70, so as to move the gripping member 70. This results in squeezing the arm 70*a* toward the arm 70*b* so that the flexible piece 70*c* bends. This causes the hook part 80 of the gripping member 70 to dislodge from its recess 72, while the lip part 82 engages with a catch 74 on the interior of frame section 66. The lip part 82 is held in this position (the second position) due to the resilience of the gripping member 70. The release tool 88 is then moved along the length of the edge of the panel 62, shifting the gripping member 70 from the first position to the second position and thereby releasing the panel 62 from the frame section 66.

It should be noted that there is no requirement for the longitudinal frame members to be vertical in use. These examples apply equally to situations where the longitudinal frame member 34, 68 is vertical, such as in a partition wall, and where the longitudinal frame member 34, 68 is horizontal, such as when the panel systems 30,60 are used to mount ceiling or floor panels.

Panel mounting systems, such as described above, may be used in a variety of applications, including, for example, use as temporary display walls in exhibition halls etc. However, many such applications place demands on the finished appearance of the temporary walls, and in some cases, the existence of a visible gap between adjacent panels (such as the gap through which the tools 32, 88 are inserted as shown in FIGS. 2*a-c* and 5*a,b*) is undesirable. For this reason these temporary walls have hitherto been constructed and then destroyed/disposed after use because it has not been possible to provide a dismantlable/re-usable panel system that has the required finished appearance. Environmental considerations mean that it is becoming unacceptable to dispose of or destroy these temporary structures.

Figure 6:
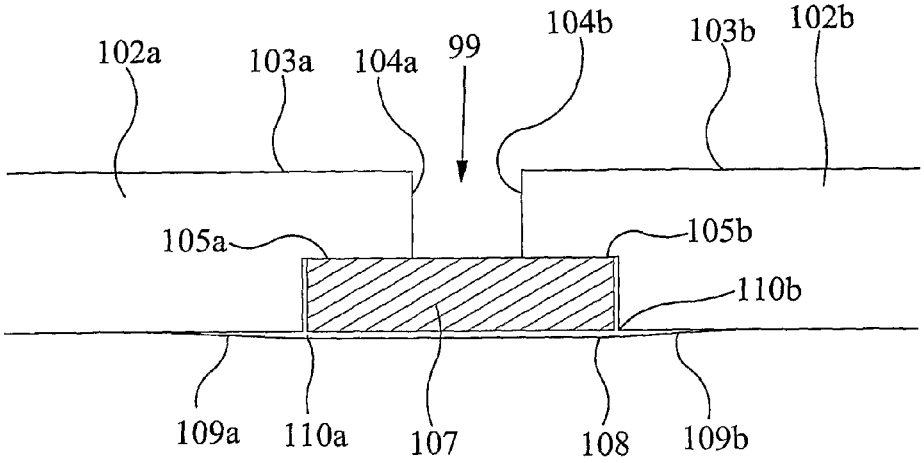
FIG. 6 is a cross-sectional view of a joint region between edges of adjacent panels.
Figure 7:
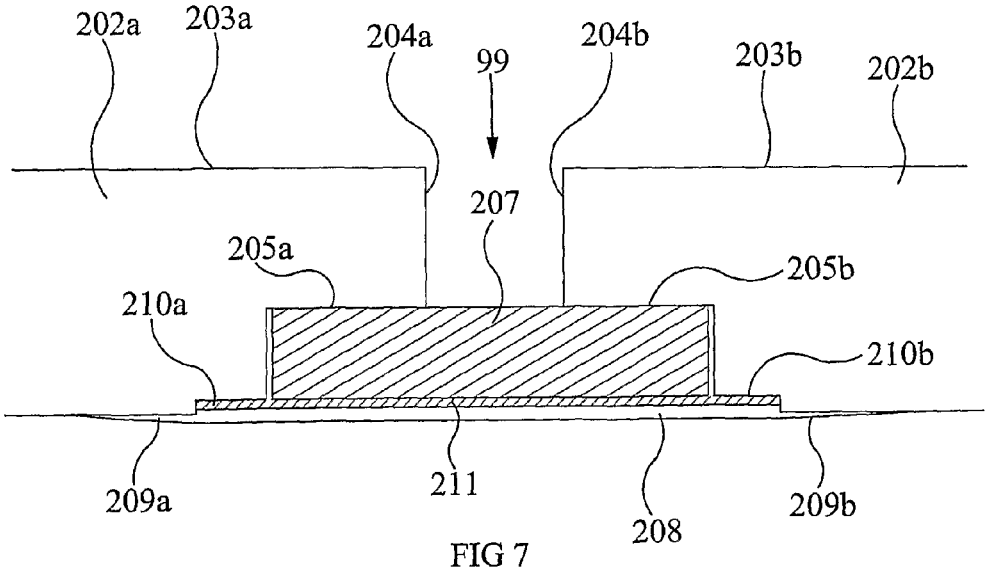
FIG. 7 is a cross-sectional view of an improved arrangement for the joint region between adjacent panels.

FIGS. 6 and 7 illustrate an approach to overcoming this problem using a panel system of the type described above (that is, a re-usable panel system in which the panels are mounted to a frame off the back faces of the panels and there is a gap between the edges of adjacent panels). FIG. 6 shows an initial approach to overcoming the problem, while an improved approach is shown in FIG. 7.

As shown in FIG. 6 two panels 102*a*, 102*b*, are mounted to a frame (not shown) off respective back faces 103*a*, 103*b* of the panels. There is a gap 99 between adjacent edges 104*a*, 104*b* of the panels. Each of the panels 102*a*, 102*b* has a recess 105*a*, 105*b* formed along the edges 104*a*, 104*b* adjacent the gap 99. The recesses 105*a*, 105*b* have a depth from the respective front faces 106*a*, 106*b* of the panels. The recess 105*a*, 105*b* receive a blocking strip 107, which may, for example, be a strip of wood or other suitable material. The blocking strip 107 may be secured to the panels 105*a*, 105*b* by means of pins, screws or other fastening means. Preferably, the fastening means allows for ease of assembly and disassembly. The blocking strip 107 extends across the gap 99 thereby obscuring the gap. To disguise the outward appearance of the blocking strip 107, a thin skim of plaster 108 is applied over the blocking strip 107, extending either side over a short distance 109*a*, 109*b* on the front faces 106*a*, 106*b* of the panels 102*a*, 102*b*. The plaster skim 108 and front faces 106*a*, 106*b* may then be painted so that the plaster and panels have the same outward appearance. The join between the two panels 102*a*, 102*b* is thereby disguised and only visible by close inspection.

A problem with the construction shown in FIG. 6 is that thin cracks can appear in the plaster skim, particularly at the locations indicated by reference numerals 110*a*, 110*b*, that is at the interface between the blocking strip 107 and the panels 102*a*, 102*b*. These cracks arise due to small movements between the panels 102*a*, 102*b* and the blocking strip 107, caused, for example, by differential expansion, or differential moisture uptake/release from the materials used.

FIG. 7 illustrates an improved construction where the cracking problem is substantially overcome. FIG. 7 shows a similar construction to that of FIG. 6 with two panels 202*a*, 202*b* mounted to a frame (not shown) off respective back faces 203*a*, 203*b* and a gap 99 between adjacent edges 204*a*, 204*b*. Each of the panels 202*a*, 202*b* has a recess 205*a*, 205*b* formed along the edges 204*a*, 204*b* similar to the recesses 105*a*, 105*b* of FIG. 6. As in FIG. 6 a blocking strip 207, for example of wood or other suitable material is secured to the panels in the recesses 205*a*, 205*b* such that the blocking strip 207 extends across the gap 99. Each panel 202*a*, 202*b* has an additional rebate 210*a*, 210*b* that extends to a distance from the panel edge 204*a*, 204*b* beyond the recesses 205*a*, 205*b* and blocking strip 207. An adhesive-backed tape 211 is applied over the blocking strip 207 and into the rebates 204*a*, 204*b*. The rebates 204*a*, 204*b* have a depth from the front faces 206*a*, 206*b* of the panels 202*a*, 202*b* that is slightly greater than the thickness of the adhesive-backed tape 211. As before, a plaster skim 208 is then applied over the adhesive backed tape 211 and extending either side over a short distance 209*a*, 209*b* on the front faces 206*a*, 206*b*.

The adhesive backed tape is preferably of a type that has a degree of resilience that enables it to take up the small movements between the blocking strip 207 and the panels 202*a*, 202*b*, caused by differential expansion. The plaster skim 208 is therefore not subjected to differential movements that would cause cracking to occur at the interface between the panels 202*a*, 202*b* and the blocking strip 207. An example of a suitable type of adhesive backed tape is a PVC tape marketed under the name Milament™.

After construction and use of a temporary panel construction as described above, the panels can be dismantled and removed for re-use by simply scraping away part of the plaster skim 208, stripping off the adhesive-backed tape 211 and then removing (e.g. unscrewing) the blocking strip 207 to uncover the gap 99. The panel construction can then be dismantled by insertion of the required tool through the gap 99 as described above with reference to FIGS. 1 to 5. Thus, the panels 202*a*, 202*b* can be re-used, the only materials that may require disposal being the adhesive-backed tape 211 and plaster skim 208.

The invention claimed is:

1. A panel mounting system comprising:

a support frame having at least one longitudinal frame member, said longitudinal frame member having a cross-section that comprises a recess and a catch, wherein the catch is adjacent to the recess; and (ii) a panel having a gripping member extending along a substantial length of the panel, the gripping member having a resiliently deflectable cross-section for engaging the longitudinal frame member;

wherein the cross-section of the gripping member is deflectable between a first position where a portion of the gripping member cross-section engages the recess so as to hold the gripping member to the support frame, and a second position where said portion of the gripping member cross-section engages the catch, the catch holding the gripping member in the second position away from the recess, so as to allow the gripping member to be released from the support frame.

2. A panel mounting system of claim 1, wherein the gripping member and support frame have cross-sections such that when the gripping member is in the first position the gripping member is squeezed into the support frame in a compressed condition.

3. A panel mounting system as claimed in claim 1, wherein the support frame also comprises lateral frame members that are engageable with the longitudinal frame member to stiffen the support frame.

4. A panel mounting system as claimed in claim 1, wherein the longitudinal frame member is formed of an extruded section.

5. A panel mounting system as claimed in claim 4, wherein the extruded section is formed of a fire resistant material, including metal.

6. A panel mounting system as claimed in claim 1, wherein the material of the panel is selected from a sheet metal material, a sheet plastics material, a sheet glass material, a sheet cardboard material or a sheet composite material.

7. A panel mounting system as claimed in claim 1, wherein the gripping member is mounted to a back face of the panel.

8. A panel mounting system as claimed in claim 7, wherein the gripping member is made from a plastics material, including polypropylene (PP) or polyvinyl chloride (PVC).

9. A panel mounting system as claimed in claim 1, wherein, the gripping member is attached adjacent the edge of the panel.

10. A panel mounting system as claimed in claim 1, wherein, the gripping member is formed by extrusion.

11. A panel mounting system as claimed in claim 1, wherein the gripping member resiliently deflectable cross-section comprises a first part for attaching to the panel and a second part for engaging the longitudinal frame member.

12. A panel mounting system as claimed in claim 11, wherein said first and second parts each comprises an arm, the arms being connected such that said cross section has a V shape.

13. A panel mounting system as claimed in claim 11, wherein said second part comprises a hook for engaging the longitudinal frame member in the first position and a lip for engaging the longitudinal frame member in the second position.

14. A panel mounting system as claimed in claim 1, wherein the gripping member resiliently deflectable cross-section further comprises a ridge against which a tool can be pushed to deflect the gripping member from the first position to the second position.

15. A panel mounting system according to claim 1, wherein the longitudinal frame member facilitates mounting of parallel panels with a space between to provide a double-panel partition whereby both sides of the partition have outward facing panels mounted to the frame.

16. A panel mounting system according to claim 1, wherein said longitudinal frame member has a cross-section configured for mounting of a pair of neighboring panels such that a gap between the panels does not exceed 5 mm.

17. A panel mounting system according to claim 1, wherein the cross section of a plurality of longitudinal frame members is such that, once a plurality of the panels have been affixed to the support frame by engagement of the gripping members, the plurality of panels and plurality of longitudinal frame members together provide a continuous barrier.

18. A panel mounting system comprising:

a support frame;

a plurality of panels mountable to the support frame off rear faces of the panels;

at least one blocking strip; and an adhesive-backed tape;

wherein at least two of said panels when mounted to said support frame have a gap between adjacent panel edges, the adjacent panel edges having a form that includes a recess for receiving said blocking strip so as to obscure said gap, and wherein each adjacent panel edge has a rebate that extends to a distance beyond said blocking strip and to a depth from a front face of the panel by an amount that is greater than a thickness of said adhesive-backed tape.

19. The panel mounting system of claim 18, wherein said adhesive-backed tape is secured over the blocking strip and to the rebates in the adjacent panels on each side of the blocking strip, facilitating application of the plaster skim over the adhesive-backed tape and onto the front faces of the adjacent panels on each side.

20. A system comprising:

a plurality of panels, a frame comprising a frame section having a generally c-shaped cross-section that includes a recess in an interior of the cross-section, said panel releasably mountable to said frame, each panel having a longitudinal gripping member attached attachable to a rear face of the panel, the gripping member having a resiliently-deflectable cross-section comprising a hook portion, said recess in said frame section receiving the hook portion of the gripping member to engage the gripping member in the frame section, wherein said gripping member is insertable into the frame section to engage the hook portion in the recess, wherein at least two of said panels when mounted adjacent one another to said support frame have a gap between adjacent panel edges, and wherein the gripping member is releasable from the frame section by insertion of a tool from a front side of the panels through said gap between the panels to deflect the hook portion away from the recess.

21. A system as claimed in claim 20, wherein the gripping member resiliently deflectable cross-section further comprises a ridge against which said tool can be pushed to deflect the hook portion away from the recess.

22. A system as claimed in claim 20 wherein said at least two of said panels when mounted adjacent one another to said support frame are in contact with the frame such that there is no passage between them from the front to the rear side of the panel system, said gap between adjacent panel edges leading only to an interior of said c-shaped frame section.

* * * * *